US005257917A

United States Patent [19]

Minarik et al.

[11] Patent Number: 5,257,917

[45] Date of Patent: Nov. 2, 1993

[54] PERISTALTIC PUMP HAVING MEANS FOR REDUCING FLOW PULSATION

[75] Inventors: Daniel Minarik, Buffalo Grove; James E. Beck, Lake Zurich, both of Ill.

[73] Assignee: Cole-Parmer Instrument Company, Chicago, Ill.

[21] Appl. No.: 955,925

[22] Filed: Oct. 2, 1992

[51] Int. Cl.[5] ..... F04B 43/12

[52] U.S. Cl. ..... 417/475; 417/477

[58] Field of Search ..... 417/475, 477

[56] References Cited

U.S. PATENT DOCUMENTS

| | | | |
|---|---|---|---|
| 1,922,196 | 8/1933 | Butler . | |
| 2,804,023 | 8/1957 | Lee | 417/477 |
| 2,913,992 | 11/1959 | Blue et al. . | |
| 3,072,296 | 1/1963 | Isreeli | 417/475 X |
| 3,431,864 | 3/1969 | Jones, Jr. . | |
| 3,723,030 | 3/1973 | Gelfand . | |
| 3,832,096 | 8/1974 | Gelfand . | |
| 3,876,340 | 4/1975 | Thomas | 417/475 |
| 3,951,570 | 4/1976 | DeBiaggi . | |
| 4,060,348 | 11/1977 | Della Bianca . | |
| 4,233,001 | 11/1980 | Schmid . | |
| 4,289,459 | 9/1981 | Neeley et al. . | |
| 4,397,639 | 8/1983 | Eschweiler et al. . | |
| 4,424,009 | 1/1984 | van Os . | |
| 4,496,295 | 1/1985 | King . | |
| 4,568,254 | 2/1986 | Terada et al. | 417/475 |
| 4,673,334 | 6/1987 | Allington et al. | 417/475 X |
| 4,834,630 | 5/1989 | Godwin | 417/477 X |
| 4,886,431 | 12/1989 | Soderquist et al. | 417/477 |
| 4,997,347 | 3/1991 | Roos . | |
| 5,011,378 | 4/1991 | Brown et al. | 417/475 X |

FOREIGN PATENT DOCUMENTS

| | | |
|---|---|---|
| WO82/03427 | 10/1982 | World Int. Prop. O. . |
| WO83/01984 | 9/1983 | World Int. Prop. O. . |

OTHER PUBLICATIONS

Pages from Cole-Parmer 1987-1988 Catalog.

*Primary Examiner*—Richard E. Gluck

*Attorney, Agent, or Firm*—Fitch, Even, Tabin & Flannery

[57] ABSTRACT

A peristaltic pump comprising a rotor and a plurality of removable cartridges associated with the rotor, wherein the occlusion beds of the cartridges are configured to enable the outflow characteristics of the pump to be varied by manipulation or interchanging of the cartridges, such that the pump may, in one mode of operation, have synchronous flow to all of its parallel flow channels, or may in a second mode of operation, have non-synchronous phase-offset flow to respective ones of the parallel flow channels. In the second mode of operation, manifolding of the output flow from respective ones of the parallel flow channels can be employed to provide flow of substantially reduced pulsation. Each of the cartridges preferably comprises a cartridge frame and a separate occlusion bed supported on the cartridge frame. In the second mode of operation, the occlusion beds of the cartridges preferably have regions of maximum occlusion offset relative to one another.

12 Claims, 5 Drawing Sheets

PERISTALTIC PUMP HAVING MEANS FOR REDUCING FLOW PULSATION

BACKGROUND OF THE INVENTION

The invention relates generally to peristaltic pumps and more specifically to a peristaltic cartridge pump for pumping fluid through a plurality of lengths of tubing.

Peristaltic pumps are preferred for certain applications due to their ability to pump fluids through tubing without any contact between pump components and the fluid being pumped. In a typical peristaltic pump system, one or more lengths of tubing are contacted by a series of rollers that generally rotate in a circular path. The peristaltic pump may be rotated by a variable-speed electric motor or other suitable drive.

Peristaltic pumps with removable cartridges are employed to pump fluid through a plurality of flexible lengths of tubing simultaneously. The removability of the cartridges is advantageous in that it enables a particular length of tubing to be removed or replaced without disturbance of other lengths of tubing in the pump. U.S. Pat. No. 4,886,431, the disclosure of which is incorporated by reference, illustrates and describes a cartridge pump which has proven to be well-suited for many laboratory applications and the like, particularly those wherein the capability for fine-tuning of the degree of occlusion is useful.

Cartridge pumps generally draw discrete volumes of fluid through the tubing by positively displacing them rotationally between the contact points of two rollers of the pump and the occlusion surface of the cartridge as the rollers rotate around the drive unit rotor. The expulsion of these discrete volumes of fluid results in pulsed flow in the output tubing. As a roller passes the end of the occlusion bed, a segment of tubing that had been pressed flat by the tubing expands, and the downstream flow velocity decreases and/or reverses direction for a brief interval. In some applications, such as liquid chromatography, the pulsating flow may cause undesirable results. In other applications, flow pulsation is not undesirable per se, but precise synchronization of flow through a plurality of parallel conduits is desired.

One suggestion for reducing pulsation in peristaltic pump outflow, set forth in U.S. Pat. No. 4,834,630, is to provide a segmented rotor having rollers in a first segment staggered or alternated with respect to rollers in a second segment, with each segment engaging a plurality of fluid conduits, and with each fluid conduit engaged by the first segment connected by a T-shaped coupler to one engaged by the second segment on the output side of the pump. Another approach which has been proposed is to employ twin tubes engaged by a pair of offset, spring-loaded tracks in a single peristaltic pumphead, with the flow from the twin tubes directed to a single tube by a Y-connector.

While pumps embodying these approaches may adequately address the problem of reduction of flow pulsation, they are not capable of providing synchronized flow through all of their parallel flow conduits. In the pump of U.S. Pat. No. 4,834,630, flow through fluid conduits associated with one of the two rotor segments is not synchronous with flow through the other rotor segment. Thus, to employ this pump in an application requiring synchronous flow through a large number of fluid conduits, the number of independent flow conduits would be limited to one-half of the number of conduits which the pump is designed to accommodate.

A general object of the invention is to provide a peristaltic cartridge pump which has greater versatility than the above-described pumps with respect to providing precisely controlled output flow meeting criteria associated with specific laboratory applications or other applications.

SUMMARY OF THE INVENTION

In accordance with the invention, there is provided a peristaltic pump comprising a rotor and a plurality of removable cartridges associated with the rotor, wherein the occlusion beds of the cartridges are configured to enable the outflow characteristics of the pump to be varied by manipulation or interchanging of cartridges such that the pump may, in one mode of operation, have synchronous pulsed flow through all of its parallel flow channels, or may in a second mode of operation have non synchronous, phase-offset flow through respective ones of the parallel flow channels. In the second mode of operation, manifolding of output flow from respective ones of the parallel flow channels can be employed to provide flow of substantially reduced pulsation, with the regions of maximum occlusion among the cartridges having a relative angular offset from one another, expressed in degrees, equal to 360° $(1+kz)nz$, where "n" is equal to the number of rollers, "z" is equal to the number of different cartridge configurations employed and "k" is any non-negative integer less than n. The cartridges are preferably reversible and have asymmetrical occlusion beds so that each cartridge is capable of providing two different configurations.

In a particular preferred embodiment of the invention, there is provided a peristaltic cartridge pump including a plurality of reversible cartridges, each having a region of maximum occlusion angularly offset from the vertical by 90°/n, where "n" is equal to the number of rollers in the pump rotor. In one mode of operation, synchronized flow through all of the cartridges may be provided by positioning all of the cartridges in the same orientation. In a second mode of operation, by reversing one-half of the cartridges on the drive unit, an offset may be provided between regions of maximum occlusion on the respective cartridges. The relative angular offset between the regions of maximum occlusion of any two adjacent cartridges, expressed in degrees, is 180°/n. This relative angular offset may be expressed as one-half of the wavelength of a single pulse, expressed in degrees of angular displacement of the rotor. In this mode of operation, flow of reduced pulsation may be effected by manifolding outputs of cartridges of opposite orientation, either pairwise or as a group.

DETAILED DESCRIPTION OF THE PREFERRED EMBODIMENT

Figure 4:
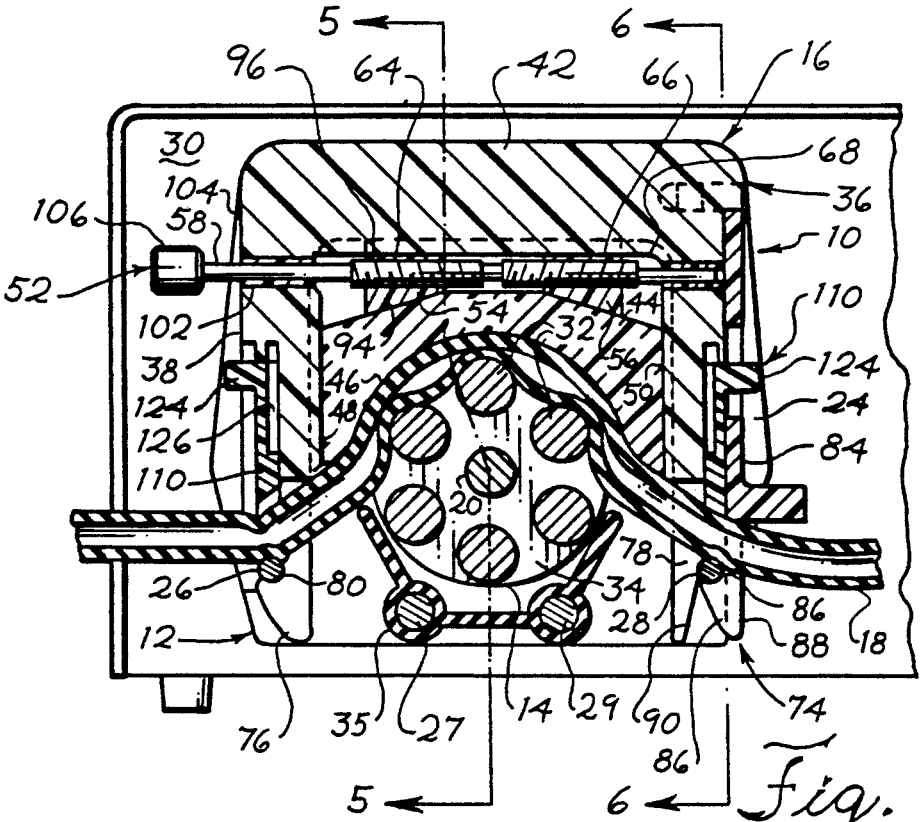
FIG. 4 is a sectional view taken substantially along line 4—4 in FIG. 1.
Figure 5:
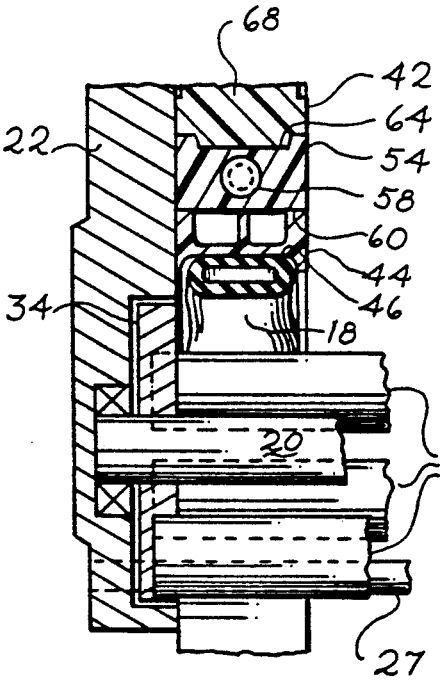
FIG. 5 is a sectional view taken substantially along line 5—5 in FIG. 4.
Figure 6:
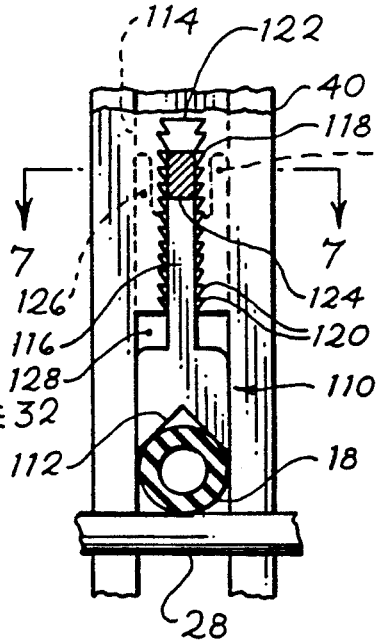
FIG. 6 is a sectional view taken substantially along line 6—6 in FIG. 4.
Figure 7:
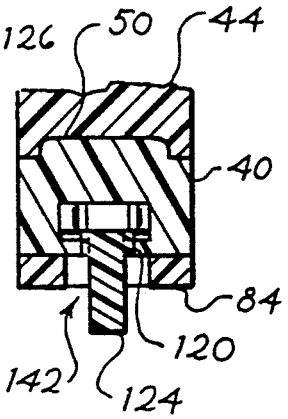
FIG. 7 is a sectional view taken substantially along line 7—7 in FIG. 6.

The preferred embodiment of the invention comprises a pump 10 which includes a frame 12, a rotor 14 supported for rotation on the frame, and a plurality of removable cartridges 16. Each of the cartridges 16 is adapted for supporting an individual segment of flexible tubing 18 in engagement with the rotor as shown in FIG. 4. Peristaltic pumping through the tubing is effected by rotation of the rotor.

The frame 12 comprises a pair of forward and rear end walls 22 and 24 and a plurality of substantially horizontal rods 26, 27, 28 and 29 connecting the end walls. The outer rods 26, 28 are positioned for cooperation with the cartridges 16 to maintain the cartridges in position on the frame as described below. The inner rods 27 and 29 are bolted to the end walls of the frame to provide rigidity for the frame. The rear wall 24 has means thereon for connecting the pump to a commercially available Masterflex pump drive/controller 30 available from Cole-Parmer Instrument Co.

The rotor 14 extends between the end walls 22, 24, and has a coupling means thereon to enable connection to a motor-driven shaft of the drive/controller 30. The rotor 14 includes a plurality of rollers 32 supported between a pair of end members 34 which are fixed to a shaft 20. Each roller 32 is carried in a circular path about the axis of the rotor, and additionally rotates about its own axis of rotation.

As a safety feature, the pump may include an elastomeric guard 35 which partially shields the lower portion of the rotor 14. The pump may also include additional guards (not shown) which are disposed between the rollers 32 and are longitudinally coextensive therewith.

Each of the removable cartridges 16 comprises a three-sided frame 36 which includes first and second generally vertical side members 38 and 40, and a generally horizontal top member 42 connecting the side members. The frame is preferably a one-piece, integral, molded structure made of a suitable plastic. Each cartridge 16 further includes a generally horizontal occlusion bed 44 disposed between the side members 38, 40 and spaced from the top member 42.

The lower surface of the occlusion bed 44 comprises a pressure surface 46 for engaging the tubing 18. The pressure surface 46 comprises an arcuate region of maximum occlusion 47, which is configured substantially as a section of a cylinder and is radially the nearest portion of the pressure surface 46 to the rotor 14. The region of maximum occlusion 47 preferably extends through an arc of greater than 360°/n, where "n" is equal to the number of rollers, so that, when an n-roller rotor is being used, at least one roller is compressing the tubing 18 against the region of maximum occlusion 47 at all times during operation. In the illustrated embodiments, the region of maximum occlusion 47 preferably extends through an arc of greater than 60° to enable the pump to function efficiently with a 6-roller rotor.

In one mode of operation, the regions of maximum occlusion 47 of the pressure surfaces 46 on the respective cartridges are offset relative to one another. Although the average flow over a period of time may be the same, the instantaneous flow rates differ between cartridges having offset regions of maximum occlusion. The flow velocities for respective cartridges having offset regions of maximum occlusion are periodic functions of time which are non-synchronous with one another, but are otherwise similar or identical.

The expressions "phase shifted" or "phase-offset" are used herein to refer to flow velocities in respective lengths of tubing which vary as a function of time in a manner substantially similar to one another, except for a phase difference. The expression "non-synchronous" refers more generally to respective flow velocities which vary in phase or otherwise with respect to one another. When the lengths of pump output tubing 18 associated with the cartridges having non-synchronous or phase-shifted flow are manifolded, more uniform flow results.

The preferred angle of relative offset is:

$$360^\circ\ (kz+1)/nz$$

where "z" is equal to the number of occlusion bed configurations, i.e., the number of different angular orientations among the regions of maximum occlusion, and "k" is any non-negative integer less than n. In the embodiment of FIGS. 1-7, $k=0$, $z=2$ and $n=6$. Thus, the angle of relative offset in this case is 30°. Where $z>2$, the angle of relative offset between a first cartridge and a second cartridge is equal to $360(kz+1)/nz$; the angle of relative offset between the second cartridge and a third cartridge is $360(kz+1)/nz$; and so on. The value of k need not be the same in every case.

In the embodiments of FIGS. 1-7, each cartridge 16 is reversible with respect to the plane of the cartridge, and the region of maximum occlusion is disposed asymmetrically on the occlusion bed. Alternate cartridges have reverse orientation, resulting in offsetting of the regions of maximum occlusion. The occlusion beds are configured such that the flow through each cartridge is phase offset with respect to flow through an oppositely oriented cartridge.

The reversibility of the cartridges enables the pump to be operated in another mode of operation in which all cartridges are oriented in the same manner, so as to provide synchronous flow through all of the flow channels. In this mode of operation, the flow velocities at any point in time will be substantially equal, and the volume of fluid delivered through each of the lengths of tubing for a particular angular displacement of the rotor will be substantially equal.

Figure 10:
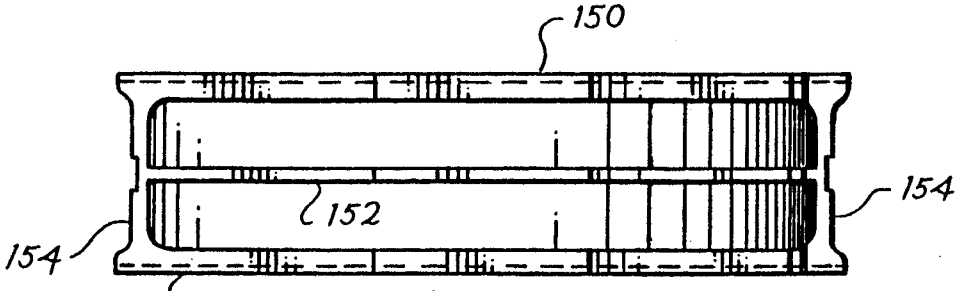
FIG. 10 is a plan view of the occlusion bed of FIG. 8.
Figure 8:
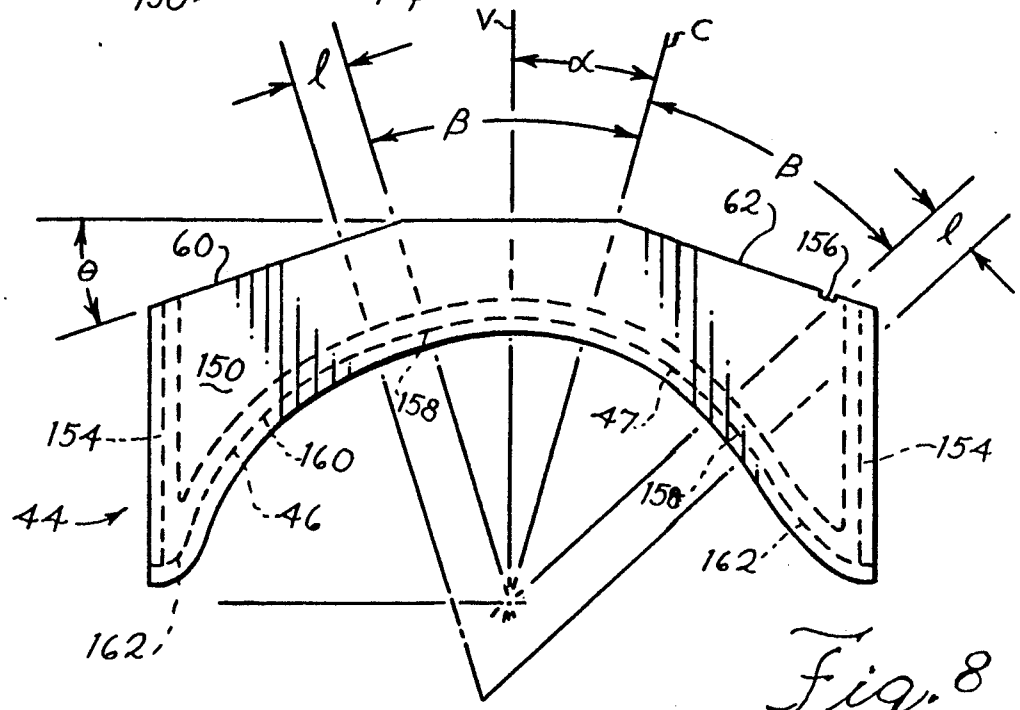
FIG. 8 is an enlarged front elevational view of the occlusion bed of the embodiment of FIGS. 1-7.
Figure 9:
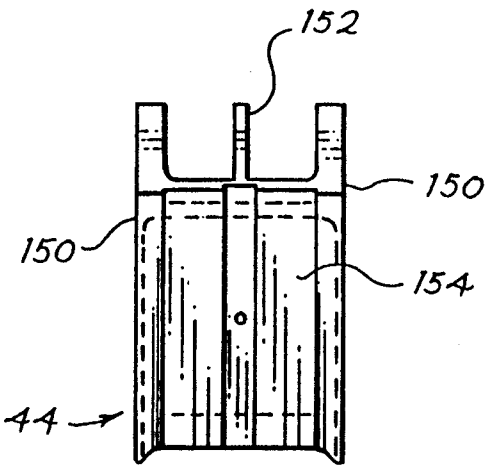
FIG. 9 is a side elevational view of the occlusion bed of FIG. 8.
Figure 13:
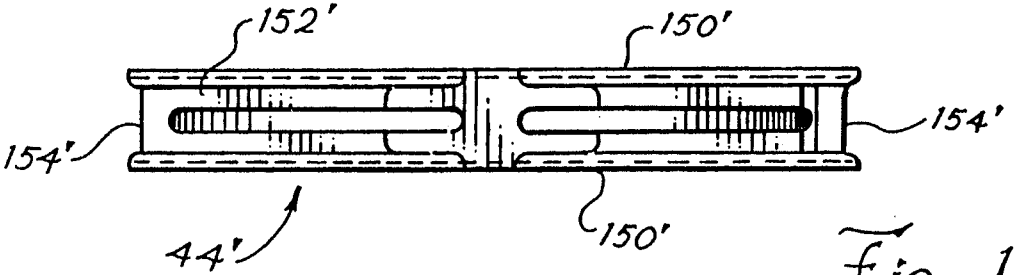
FIG. 13 is a plan view of the occlusion bed of FIG. 11.
Figure 11:
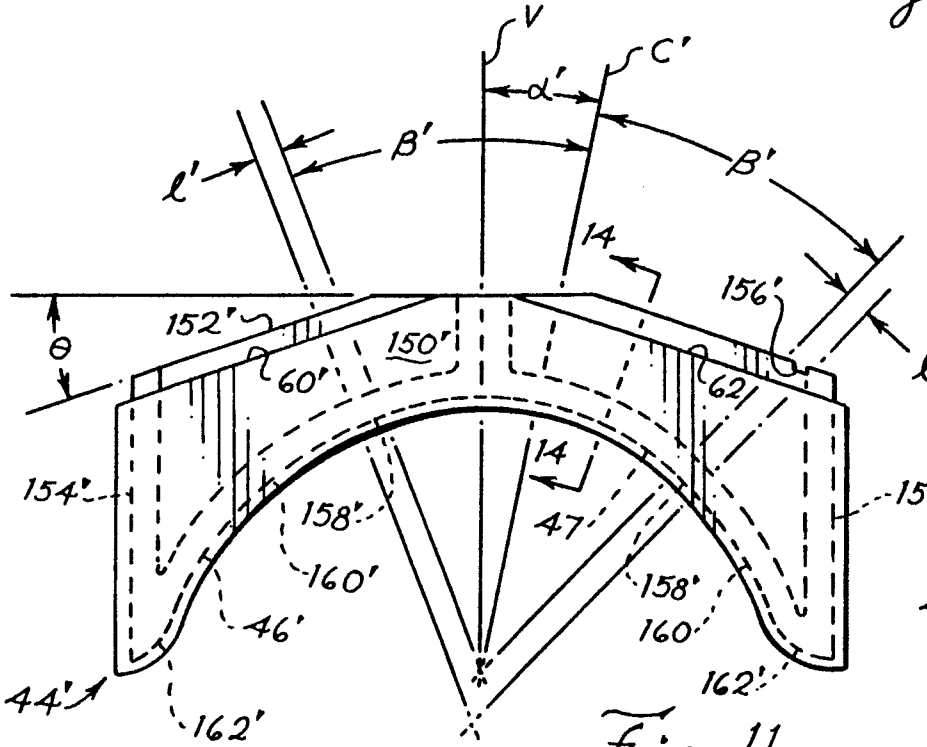
FIG. 11 is a front elevational view of an alternate occlusion bed.
Figure 14:
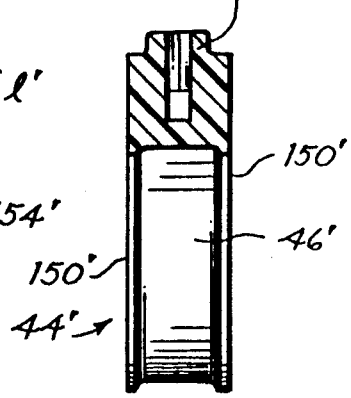
FIG. 14 is a sectional view taken substantially along line 14-14 in FIG. 11.
Figure 12:
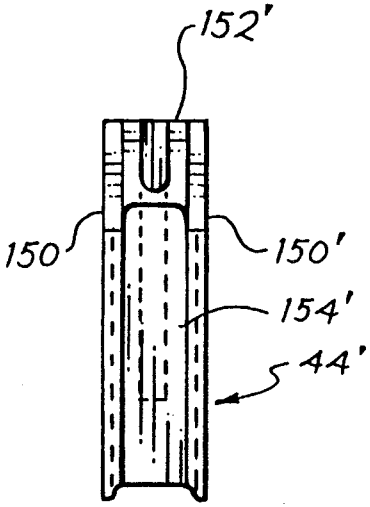
FIG. 12 is a side elevational view of the occlusion bed of FIG. 11.

FIGS. 8-10 illustrate in detail the occlusion bed 44 shown in FIGS. 1-7. Referring to FIG. 8, a radial line bisecting the region of maximum occlusion is indicated at C. The vertical is indicated at V. The offset of the region of maximum occlusion is indicated by $\alpha$, the included angle between line V and line C.

The cartridge of FIG. 8 is intended for use in the context of a 6-roller rotor and, accordingly, a 30° offset between adjacent cartridges is provided. To this end, in the embodiment of FIG. 8, $\alpha=15°$. The region of maximum occlusion 47 has an angular dimension of $2\beta$ and, in the embodiment of FIG. 8, has an angular dimension of 65.5°, with B=32.75°. The region of maximum occlusion 47 has a substantially uniform radius of curvature about the rotor axis of about 1 in. Thus, the region of maximum occlusion is substantially cylindrical, i.e., configured substantially as part of a cylinder.

At each end of the region of maximum occlusion 47, substantially planar regions 158 of equal dimension extend tangentially therefrom, along a distance equal to about 0.2 in. The substantially planar tangential regions 158 facilitate transition between the region of maximum occlusion and regions of lesser occlusion at either end thereof without unacceptably high dynamic loading on pump components.

Disposed outwardly of the planar tangential regions at each end of the occlusion bed are arcuate transition regions 160 which are oriented to further decrease occlusion as the rotor proceeds away from the adjacent planar tangential region 158. The occlusion bed has outwardly flared portions 162 at each of its ends at the locations at which the rollers engage and disengage the tubing.

Due to the reversibility of the cartridges, the occlusion bed 44 may be engaged by rollers rotating either clockwise or counterclockwise with respect to FIG. 8. For purposes of illustration, the progress of a roller along the occlusion bed of FIG. 8, traveling clockwise relative thereto, will be described. The roller first engages the tubing at the outwardly flared region 162 of the occlusion bed at the left of FIG. 8, and the occlusion of the tubing progressively increases as the roller travels along the occlusion bed to the edge of the region of maximum occlusion 47. The roller then traverses an arc of $2\beta$ degrees, maintaining maximum occlusion on the tubing. The distance between the roller and the occlusion surface then progressively increases until the roller reaches the flared end 162 of the occlusion bed at the right of FIG. 8, and loses contact with the tubing.

The occlusion bed as illustrated in FIG. 8 is preferably an injection-molded plastic structure comprising forward and rear vertical walls 150, a vertical reinforcing rib 152, and left and right vertical endwalls 154. Aligned slots 156 are provided at one side of each of the front and rear walls to provide, by themselves or in conjunction with an inserted indicia, a visual reference to facilitate visual determination of the orientation of the occlusion bed.

FIGS. 11–14 illustrate an occlusion bed 44' in accordance with an alternate embodiment of the invention. The occlusion bed 44' is similar to that of FIGS. 8–10, but has a narrower configuration, i.e., a smaller dimension along the rotor axis, for accommodating a smaller diameter tubing, and has a configuration particularly configured for use in an 8-roller pump. In FIGS. 11–14, primed reference numerals corresponding to the reference numerals of FIGS. 8–10 are employed to indicate similar components.

In the occlusion bed of FIGS. 11–14, the rib 152' is slotted and has its upper surface raised slightly along camming surfaces 60' and 62' for tongue and groove engagement with a corresponding slot in the bottom surfaces of the wedges employed with the occlusion bed 44'. The rib 152' is contiguous with the front and rear walls.

In the occlusion bed of FIGS. 11–14, $\alpha'=11.25°$ thereby providing a relative angular offset between relatively reversed cartridges of 22.5°. The region of maximum occlusion is configured similarly to that of FIGS. 8–10, with $\beta'=32.75°$. The smaller diameter of the tubing enables the planar regions 158' to be somewhat shorter, e.g., about 0.1 in. It may be noted that the angular dimension of the region of maximum occlusion 47' of the occlusion bed of a cartridge for use in an 8-roller pump might be configured so as to provide a $\beta'$ of less than 32.75°. Indeed, adequate performance would be expected so long as $\beta'>22.5°$. However, provision of $\beta'=32.75°$ in the cartridge of FIGS. 11–14 enables the cartridge to be used in a 6-roller pump as well as in an 8-roller pump, albeit without optimal pulsation reduction in the context of a 6-roller pump.

Figure 1:
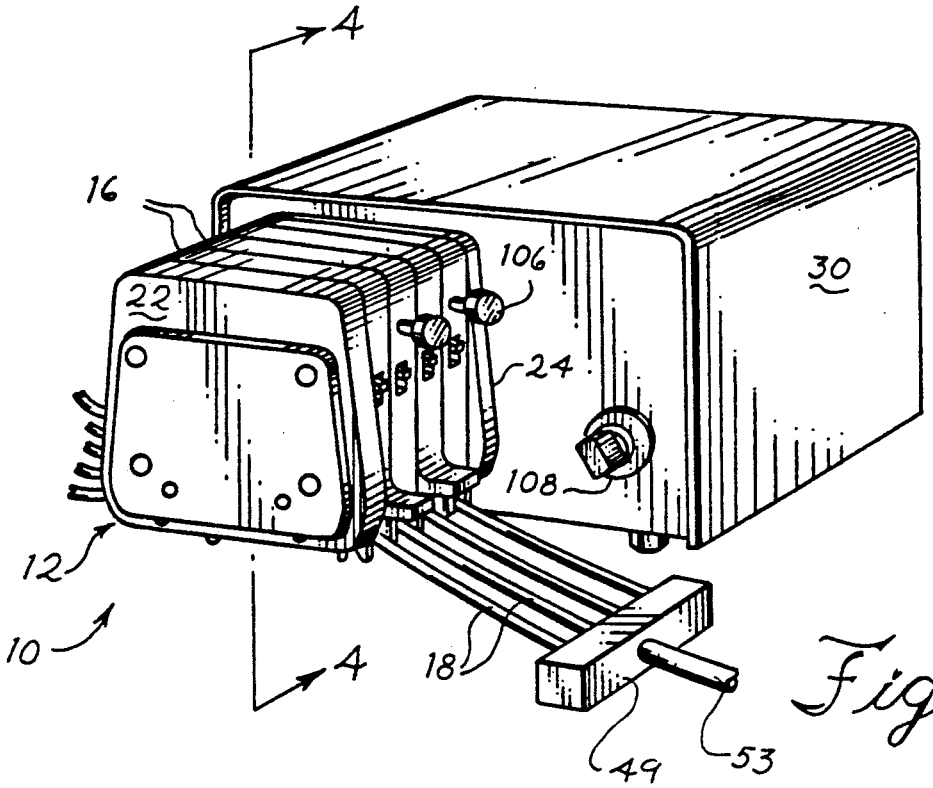
FIG. 1 is a perspective view of a pump in accordance with the invention.
Figure 2:
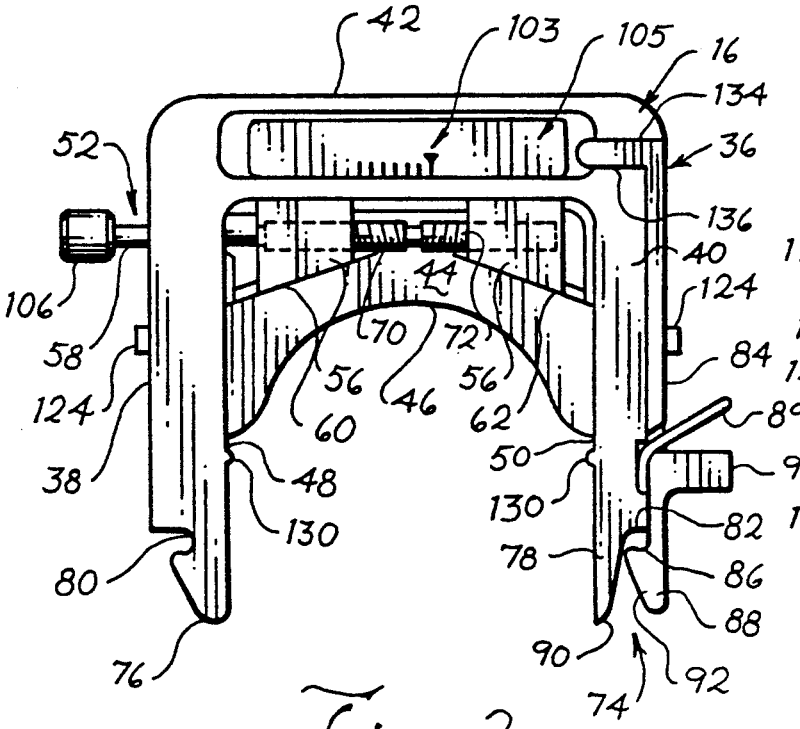
FIG. 2 is a front elevational view of a cartridge for the pump of FIG. 1.
Figure 3:
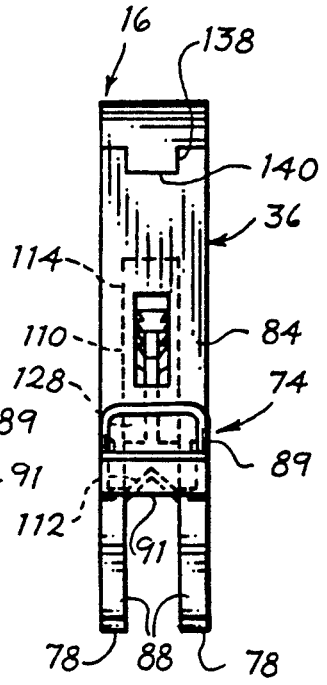
FIG. 3 is a side elevational view of the cartridge of FIG. 2.

In order to combine a plurality of phase offset pulsed flows into a relatively uniform flow, a plurality of pump output lengths of tubing 18 are connected to a manifold 49 which has its outlet connected to a larger length of tubing 53 as illustrated in FIG. 1. While FIG. 1 illustrates four lengths of tubing 18 connected as a group to a single manifold, it will be appreciated that in other embodiments, a plurality of lengths of tubing may alternatively be connected pairwise to a plurality of manifolds, i.e., with only two cartridge outputs being combined at each manifold.

Figure 15:
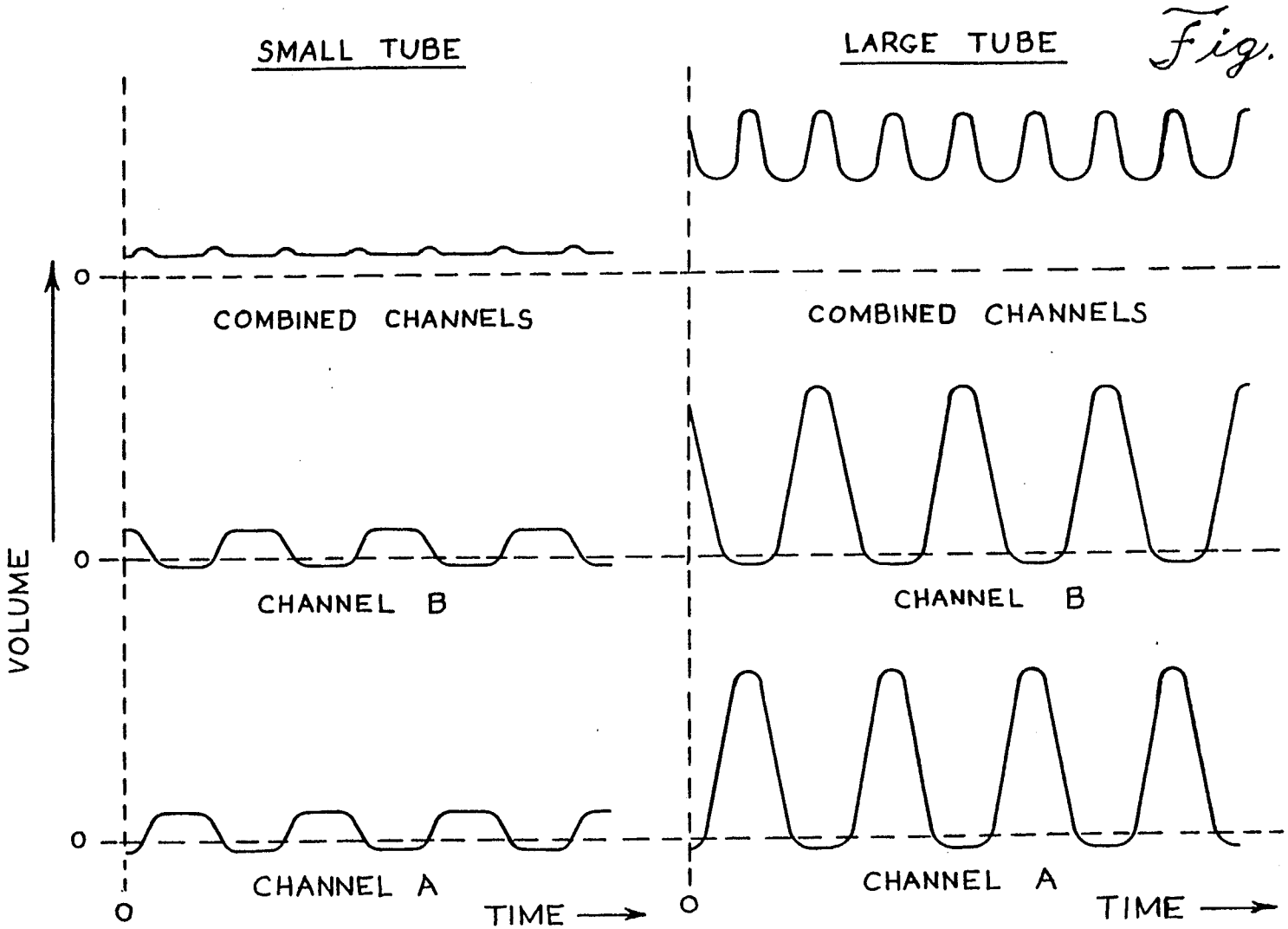
FIG. 15 is a qualitative graphic representation of fluid flow as a function of time, showing combined flow resulting from manifolding of two individual phase-offset flows.

The effect of combining two phase-offset pulsed flows is qualitatively illustrated in FIG. 15. The left-hand side of FIG. 15 illustrates flow through relatively small diameter tubing, with volume plotted as a function of time. Flow through a first length of tubing, i.e., "Channel A," is illustrated in the lowermost plot. Flow through a second length of tubing, i.e., "Channel B", is plotted immediately thereabove. The combined flow through the two channels is illustrated in the uppermost plot. The horizontal broken line in each plot represents zero flow, with negative flow volume representing flow in the direction opposite to that desired. Negative flow volume typically occurs in a length of tubing associated with a single cartridge as tubing occlusion rapidly decreases locally when a roller reaches the end of the occlusion bed.

The right-hand side of FIG. 15 is a similar diagram, using the same conventions to illustrate flow volume as a function of time for relatively large diameter tubing.

As may be seen from FIG. 15, flow volume downstream from the peristaltic pump may be viewed as a periodic function of time, with each pulse being represented by a single substantially symmetrical wave. The number of pulses in a single 360° revolution of the rotor is equal to the number of rollers. As shown in the uppermost plots, the offsetting of occlusion in accordance with the invention, wherein the pulses are offset relative to one another in two flow channels, by one-half wavelength, results in elimination of reverse flow entirely, substantial reduction in the amplitude of pulsation, and doubling the frequency of pulsation.

Referring to the equation $360°\ (1+kz)/nz$, as defined above, in both cases illustrated in FIG. 15, z=2. However, further reduction in magnitude of flow volume pulsation may be obtained in any particular case by increasing z, subject to structural limitations imposed by the particular pump configuration.

Referring to FIGS. 1-7, to permit adjustment of occlusion along the pressure surface 46 of the occlusion bed 44, the occlusion bed 44 is vertically movable in rectilinear motion, being mounted in slidable engagement with the inner surfaces 48, 50 of the side members 38 and 40 of the cartridge frame. The occlusion bed has its vertical position controlled by an adjustment mechanism 52. The top of the occlusion bed 44 is configured for camming engagement with a pair of wedges 54, 56 which are horizontally movable and which are in threaded engagement with an adjustment screw 58. More particularly, oppositely sloping camming surfaces 60, 62 of the occlusion bed 44 slidably engage the respective wedges 54 and 56.

The adjustment screw 58 has a pair of threaded portions 70, 72 of opposite hand, one threaded portion being in engagement with each of the wedges, so that rotation of the adjustment screw drives the wedges in opposite directions. Each of the camming surfaces 60 and 62, and the lower surface of each wedge, is inclined at an angle $\theta$ of preferably 18.4°. This provides a sufficient range of vertical displacement of the occlusion bed over the range of travel of the wedges while also providing an acceptable mechanical advantage in adjustment, and maintaining friction between the wedges and the outer camming surfaces of the occlusion bed within acceptable limits.

Each of the wedges 54, 56 has a groove 64, 66 on its upper surface for slidably engaging a downwardly-projecting ridge 68 on the lower surface of the top 42 of the cartridge to provide a tongue-and-groove engagement. The wedges are thereby constrained for rectilinear movement horizontally along a line extending between the side members 38, 40. The rigidity of the adjustment screw 58 also aids in constraining the wedges.

The occlusion bed 44 may be installed or removed by applying pressure to pull the respective side members 38, 40 slightly apart. The side members 38, 40 are sufficiently flexible and resilient to enable this to be accomplished manually. The cartridge frame 36 is capable of receiving in the same manner occlusion beds of conventional, symmetrical configuration having regions of maximum occlusion extending at a uniform radius over an arc of over 120° for use in three-roller pumps.

To provide for mounting of the cartridges on the pump frame 12, the cartridges have means for engaging the outer rods 26 and 28. The left side member 38 of the cartridge 16 has a pair of legs 76 extending downwardly at its lower end. The legs have aligned notches 80 therein for engaging one of the support rods 26 or 28. The opposite side member 40 has a locking mechanism 74 for engaging the other support rod 26 or 28.

The locking mechanism 74 is formed by the combination of a pair of legs 78 having notches 82 therein which face generally outwardly and downwardly on the side member, defining an internal radius for engaging the rod 28, and a resilient, flexible member 84 having legs 88 with inwardly-facing notches 86 thereon for engaging the outer, lower surface of the rod 28.

The legs 78 and 88 have downwardly diverging camming surfaces 90, 92 formed thereon to facilitate locking of the cartridge 16 in place. The cartridge may be placed "on line" by first engaging the notches 80 on the left side legs 78 with one of the rods 26, and pivoting the cartridge downward until the resilient member 84 is cammed outwardly, then snaps back into its original position, locking the cartridge in place. A handle 91 is provided to facilitate manipulation of the cartridge 16.

To facilitate release of the locking mechanism, a lever 89 may be provided for camming the flexible member 84 outwardly. The illustrated lever 89 comprises a wire bail having its ends pivotally mounted on the side member 40 of the frame. The lever 89 has two side portions extending upwardly from the ends to a horizontal portion that extends across the width of the cartridge 16. Each of the side portions extends substantially vertically upward for a short distance, then curves through an obtuse angle to extend outwardly and upwardly over the handle 91. When the lever is pressed downwardly by the user into contact with the handle, the lower part of the lever cams the flexible member 84 outwardly.

The flexible member 84 is fixed to the adjacent portion of the cartridge frame by engagement between a pair of legs 134 at the upper end of member 84 and corresponding slots 136 in the frame; and by engagement between a notch or recess 138 formed between the legs 134 and an interfitting boss 140 on the cartridge frame 36. The flexible member 84 has a slot 142 therein through which a handle 124 of the tubing retainer extends.

During operation of the pump 10, relatively high upward force is exerted on the occlusion bed 44, and the cartridge 16 is subject to vibration as well. To enable the adjustment mechanism 52 to be easy to operate without being subject to displacement in response to the force and vibration exerted on the occlusion bed, static friction is employed to provide rotational stability of the adjustment screw 58. To this end, the adjustment screw 58 is preferably engaged by rubber bushings 102 provided in the bores 104 in the side members 38 and 40 of the cartridge frame 36. A large knob 106 with a knurled cylindrical exterior surface is employed to aid the user in overcoming the static friction to make adjustments.

The pump controller 30 contains a variable speed electric motor and a control circuit for adjusting the motor speed. The motor rotates a shaft coupled to the rotor 14. The rear end wall 24 of the pump frame has four screw holes therein, each with a counterbore for receiving a screw head. The screw holes align with threaded bores opening on the front surface of the pump control unit. A knob 108 enables manual adjustment of the pump speed.

During operation of a peristaltic pump, longitudinal force is exerted on the segment of tubing within the pump, tending to pull the tubing through the pump in the direction of rotation of the rotor. To prevent such displacement of the tubing, in some instances clips or stops are attached to the tubing for engagement with the exterior of the pump housing. In other cases, means are provided on the pump itself to constrain the tubing against longitudinal movement. In the illustrated embodiment of the invention, a tubing retainer mechanism is provided on each cartridge.

As illustrated in FIG. 4, the tubing 18 for each cartridge passes over the outer rods 26, 28 which extend between the forward and rearward walls 22 and 24 of the frame 12. To prevent longitudinal displacement of the tubing in response to pumping forces, each of the tubing retainers 110 exerts downward pressure on the tubing, holding it between a generally V-shaped notch 112 at the lower end of the tubing retainer and a respective one of the rods 26, 28. The V-shaped notch 112 has a corner edge thereon formed by the intersection at acute angle of a substantially vertical outer surface with a sloping, V-shaped bottom surface. The edge at the intersection has a radius of about 0.01 in. The dimension of the bottom surface in the direction of the length of the tubing is about 0.25 in.

Each of the tubing retainers 110 is constrained by an internal channel 114 in its associated side member 38 or 40 of the cartridge 16 so that it has one degree of freedom only, being movable only in linear vertical motion. Each of the illustrated tubing retainers 110 has an elongated body 128 extending into the channel 114. The body includes a pair of spaced legs 126 which extend vertically upward from the lower notched portion of the retainer, in sliding contact with the channel. The legs may be connected by a link (not shown) across their upper ends. To provide for manual control of the position of the retainer, and for locking of the retainer in a selected position, the retainer includes a cantilevered arm 116 having a plurality of teeth 118 thereon for engaging complementary teeth 120 on the interior of a slot 122. The slot 122 is disposed between the channel 114 and the exterior of the cartridge 16.

The arm 116 is made of a flexible, resilient material, and is movable between a first, undeformed position in which it is substantially vertical, and a second position in which it is deflected inward. When in its undeformed position, the arm 116 has its teeth 118 in locking engagement with the teeth 120 on the slot. When adjustment is desired, a projection or handle 124 on the arm 116 is pressed inward by the user, deflecting the upper end of the arm 116 inward between the legs 126 out of engagement with the teeth 120. The vertical position of the tubing retainer 110 may then be adjusted as desired. When the desired position is reached, the arm 116 need only be released and allowed to return to its undeformed position. This locks the retainer 110 in its new position.

The illustrated teeth 118 and 120 are configured to facilitate downward movement of the tubing retainer 110 and provide added mechanical resistance to upward movement, thereby avoiding unintended upward displacement of the tubing retainer due to pressure and pulsation attendant to the pumping operation. The internal channel 114 has relatively smooth sides, and is disposed in a different plane from the slot 122. This provides for smooth sliding of the tubing retainer when the arm 116 is depressed.

Stops 130 are provided on the interiors of the side members 38, 40 to limit downward travel of the occlusion bed. While the pump 10 is in use, upward pressure on the occlusion bed maintains the occlusion bed in place. When the cartridge 16 is removed from the pump 10, the stops 130 act to prevent the occlusion bed from being separated from the cartridge frame 36.

In determining the occlusion setting of the pump, several factors may be taken into consideration. First, the occlusion setting may be used to fine tune the flow rate. Increases in occlusion produce increases in output pressure and flow rate over a certain range, independent of the rotor speed. The degree of occlusion also affects the amplitude of pulsation in the flow rate. Additionally, increased occlusion decreases tubing life due to the increased strain experienced by the tubing with increased occlusion.

Indicia 103 are preferably provided on a label 105 on the side of the cartridge frame to enable comparison of wedge positions with predetermined reference points, thus facilitating repetition of occlusion settings. In the absence of indicia, the number of visible threads on the adjustment screw 58 adjacent each of the wedges may be viewed and counted to provide a visual reference.

From the foregoing it will be appreciated that the invention provides a novel and improved pump. The invention is not limited to the embodiments described herein above, or to any particular embodiment.

The invention is described with greater particularity by the following claims. It should be understood that the use of terms such as "horizontal", "vertical", etc. in the following claims is intended to describe only the orientation of the various components relative to one another. It is not intended to otherwise limit the claims with respect to the actual orientation of the pump components.

What is claimed is:

1. A peristaltic pump comprising:

a drive unit including a stationary frame and a rotor supported on said frame for rotation;

a plurality of removable cartridges disposed side-by-side on said drive unit;

each of said removable cartridges comprising a cartridge frame and an occlusion bed;

said rotor having a generally horizontal axis and including rotatable support means and a plurality of elongated, parallel rollers, said rollers being carried by said rotatable support means in a circular path about the axis of said rotor, each roller further having its own axis of rotation and being rotatable thereabout;

each of said removable cartridges being configured for cooperation with said drive unit so that for each cartridge a length of flexible tubing may be supported between the occlusion bed and the rotor to enable effectuation of peristaltic pumping of fluid through said length of tubing by rotation of said rotor;

a first one of said cartridges having a region of maximum occlusion on its occlusion bed;

a second one of said cartridges having a region of maximum occlusion on its occlusion bed substantially offset from said region of maximum occlusion on said first cartridge, whereby flow through tubing associated with said first cartridge is substantially non-synchronous with flow through tubing associated with said second cartridge; and means for manifolding said lengths of flexible tubing to combine outflow therefrom so as to provide a combined flow having reduced pulsation as compared with flow through one of said lengths of flexible tubing;

wherein the offset between the regions of maximum occlusion in the occlusion beds of said first cartridge and said second cartridge, expressed in degrees, is an odd integral multiple of 180°/n, where n is equal to the number of said rollers.

2. A peristaltic pump in accordance with claim 1 wherein the occlusion beds of said first and second ones of said cartridges have substantially similar shape, except that the occlusion bed of said second cartridge is reversed relative to the occlusion bed of said first cartridge, said reversal causing the respective regions of maximum occlusion of said first cartridge and said second cartridge to be substantially offset.

3. A peristaltic pump in accordance with claim 1 having at least one cartridge with at least a portion of said occlusion bed therein substantially cylindrical, coaxial with said rotor, so as to provide substantially uniform occlusion over said portion of said occlusion bed.

4. A peristaltic pump in accordance with claim 1 wherein at least one of said occlusion surfaces comprises a combination of at least one substantially arcuate surface and at least one substantially planar surface.

5. A peristaltic pump in accordance with claim 1 wherein n=6.

6. A peristaltic pump comprising:

a drive unit including a stationary frame and a rotor supported on said frame for rotation;

a plurality of removable cartridges disposed side-by-side on said drive unit;

each of said removable cartridges comprising a cartridge frame and an occlusion bed;

said rotor having a generally horizontal axis and including rotatable support means and a plurality of elongated, parallel rollers, said rollers being carried by said rotatable support means in a circular path about the axis of said rotor, each roller further having its own axis of rotation and being rotatable thereabout;

each of said removable cartridges being configured for cooperation with said drive unit so that for each cartridge a length of flexible tubing may be supported between the occlusion bed nd the rotor to enable effectuation of peristaltic pumping of fluid through said length of tubing by rotation of said rotor;

each of said cartridges having a region of maximum occlusion on its occlusion bed;

each of said cartridges being reversible and having its region of maximum occlusion disposed asymmetrically on its occlusion bed such that reversal of one of said cartridges relative to another of said cartridges results in phase-shifted flow through respective lengths of tubing associated with the respective cartridges; and means for manifolding lengths of flexible tubing emanating from the outputs of said cartridges so as to combine the outflows therefrom;

wherein the offset between the regions of maximum occlusion on adjacent cartridges, expressed in degrees, is an odd integral multiple of 180/n where n is equal to the number of said rollers.

7. A peristaltic pump in accordance with claim 6 wherein said cartridges are disposed in alternating fashion such that each cartridge is reversed relative to each other cartridge adjacent thereto.

8. A peristaltic pump in accordance with claim 6 wherein each of said occlusion beds is slidably displaceable in rectilinear travel on its associated cartridge frame for purposes of adjusting occlusion.

9. A peristaltic pump comprising:

a drive unit including a stationary frame and a rotor supported on said stationary frame for rotation thereon, said rotor comprising a plurality of rollers;

a plurality of removable cartridges, each of said cartridges comprising a cartridge frame and a separate occlusion bed, said occlusion bed being supported on said cartridge frame, said cartridge frames being substantially similar to one another, each of said occlusion beds having an occlusion surface thereon;

a plurality of lengths of flexible tubing, each of said lengths of flexible tubing being supported between said rotor and a respective one of said occlusion surfaces;

each of said occlusion surfaces being configured for cooperation with said drive unit so that for each occlusion surface a length of flexible tubing may be supported between the occlusion surface and the rotor such that flow through said lengths of flexible tubing is effected by rotation of the rotor; and at least two of said occlusion surface being configured such that flow through one of the lengths of flexible tubing associated with said at least two of said occlusion surfaces is non-synchronous with flow through at least one other of said lengths of tubing; and means for manifolding said lengths of flexible tubing to combine outflow therefrom; said at least two occlusion surfaces each having a region of maximum occlusion, said regions of maximum occlusion being arranged to define an offset therebetween;

wherein the offset between the regions of maximum occlusion of said at least two occlusion surfaces, expressed in degrees, is $360\ (kz+1)/nz$, where "n" is equal to the number of rollers, "z" is equal to the number of angular orientations of maximum region of occlusion employed, and "k" is any non-negative integer less than n.

10. A peristaltic pump comprising:

a drive unit including a stationary frame and a rotor supported on said stationary frame for rotation thereon, said rotor comprising a plurality of rollers;

a plurality of removable cartridges, each of said cartridges comprising a cartridge frame and a separate occlusion bed, said occlusion bed being supported on said cartridge frame, said cartridge frames being substantially similar to one another, each of said occlusion beds having an occlusion surface thereon;

a plurality of lengths of flexible tubing, each of said lengths of flexible tubing being supported between said rotor and a respective one of said occlusion surfaces;

each of said occlusion surfaces being configured for cooperation with said drive unit so that for each occlusion surface a length of flexible tubing may be supported between the occlusion surface and the rotor such that flow through said lengths of flexible tubing is effected by rotation of the rotor; and at least two of said occlusion surfaces being configured such that flow through one of the lengths of flexible tubing associated with said at least two of said occlusion surfaces is non-synchronous with flow through at least one another of said lengths of tubing; and means for manifolding said lengths of flexible tubing to combine outflow therefrom;

said at least two occlusion surfaces each having a region of maximum occlusion, said regions of maximum occlusion being arranged to define an offset therebetween;

wherein the offset between the regions of maximum occlusion in the occlusion surfaces of said at least two occlusion surfaces, expressed in degrees, is an odd integral multiple of 180°/n, where n is equal to the number of said rollers.

11. A peristaltic pump in accordance with claim 10 wherein at least one of said occlusion surfaces comprises a combination of at least one substantially arcuate surface and at least one substantially planar surface.

12. A peristaltic pump in accordance with claim 10 wherein n=6.

* * * * *